US006855003B1

(12) United States Patent
Wyant

(10) Patent No.: US 6,855,003 B1
(45) Date of Patent: Feb. 15, 2005

(54) MULTIPLE USE CONNECTOR FOR A GPS SYSTEM ON A MARINE VESSEL

(75) Inventor: John W. Wyant, Maynard, MA (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 10/685,164

(22) Filed: Oct. 14, 2003

(51) Int. Cl.[7] ..... H01R 11/00; H01R 33/00; H01R 13/648; H01R 24/04

(52) U.S. Cl. ..... 439/502; 439/34; 439/108; 439/668

(58) Field of Search ..... 439/502, 650, 439/652, 265, 639

(56) References Cited

U.S. PATENT DOCUMENTS

| | | | | | |
|---|---|---|---|---|---|
| 4,286,262 | A | | 8/1981 | Wahl | 340/694 |
| 4,842,235 | A | | 6/1989 | Brown et al. | 248/447.2 |
| 5,007,863 | A | | 4/1991 | Xuan | 439/639 |
| 5,331,580 | A | * | 7/1994 | Miller et al. | 708/173 |
| 5,633,538 | A | | 5/1997 | Nickerson | 307/10.8 |
| 5,708,706 | A | | 1/1998 | Hughes et al. | 379/446 |
| 5,860,824 | A | | 1/1999 | Fan | 439/265 |
| 5,876,248 | A | * | 3/1999 | Brunker et al. | 439/608 |
| 6,007,372 | A | * | 12/1999 | Wood | 439/502 |
| 6,212,415 | B1 | * | 4/2001 | Demuro et al. | 455/575.7 |
| 6,273,771 | B1 | | 8/2001 | Buckley et al. | |
| 6,338,563 | B1 | | 1/2002 | Norman | 362/268 |
| 6,368,155 | B1 | * | 4/2002 | Bassler et al. | 439/620 |
| 6,394,846 | B1 | * | 5/2002 | Belopolsky et al. | 439/620 |
| 6,396,388 | B1 | | 5/2002 | Dong | 340/5.62 |
| 6,682,356 | B2 | * | 1/2004 | Erez et al. | 439/108 |

* cited by examiner

*Primary Examiner*—Chandrika Prasad
(74) *Attorney, Agent, or Firm*—William D. Lanyi

(57) ABSTRACT

A tubular receptacle, which is generally similar in appearance with a female cigarette lighter, is provided with communication contacts that allow a specifically designed insert member to be disposed within a cavity of the tubular receptacle to accomplish a simultaneous connection of electrical power between the vehicle and a portable electrical device and the connection of data links between those two components. By simply inserting the insert into the cavity of the tubular receptacle, data connections and power connections are made at the same time and without the need to make separate connections to accomplish these purposes.

30 Claims, 3 Drawing Sheets

MULTIPLE USE CONNECTOR FOR A GPS SYSTEM ON A MARINE VESSEL

BACKGROUND OF THE INVENTION

1. Field of the Invention

The present invention is generally related to a vehicle electrical connection system and, more particularly, to a connection device that allows a portable electronic component to be connected to the electrical system of a vehicle in a manner that provides connection of both electrical power and signal communication lines.

2. Description of the Prior Art

It is well known that receptacles previously used solely as cigarette lighters, can be used to provide electrical power to many components in a vehicle. For example, portable compasses and radar detectors commonly use a cigarette lighter receptacle in an automobile as a power source.

U.S. Pat. No. 6,396,388, which issued to Dong, on May 28, 2002, describes a remote starter device for cars. The remote starting device is intended chiefly for use in cars that utilize a pulse signal that is generated by either an RF transmitter, a keypad, or a telephone. The pulse signal is transmitted to a routing drive attached to the subject ignition. When the device receives the pulse signal, the rotating drive rotates to activate the ignition of the car, thereby starting the engine. The remote starting device operates independently of the car's circuitry using only the car's battery, via the cigarette lighter, as a power source. There is no need to modify the car's electrical system to install the device. This greatly simplifies installation of the device and does not jeopardize any applicable warranty on the car.

U.S. Pat. No. 6,338,563, which issued to Norman on Jan. 15, 2002, describes a lighted sign display assembly. A lighted sign display assembly includes a housing of lens aperture formed at a base end of the housing. The lens aperture secures the lens to the housing within the lens aperture, and the lens has areas that are formed to convey visual information. The housing may be ellipsoid-shaped, and the illumination assembly may include a power adapter coupled to the running lights or cigarette lighter of a vehicle to thereby apply electrical energy to the illumination assembly.

U.S. Pat. No. 6,007,372, which issued to Wood on Dec. 28, 1999, describes a GPS power/beta cable system. A device for coupling global positioning system (GPS) to computer systems in a way that takes advantage of available power supplies is described. The device includes an adaptive power base that may be used to replace the standard battery-pack basis of many portable GPS receivers. The adaptive power base is coupled through an interface cabling system to an external power supply. The power supply maybe associated with a computer means, such as a mouse or keyboard port, or it may be a completely separate source, such as an automobile's cigarette outlet. The interface cabling system includes coupling for linking the beta communications port of the GPS receiver and the computer system together. The GPS receiver is more adaptive to available power sources and therefore may be used for longer periods of time in a variety of locations. The design is simple in that it includes standard connectors.

U.S. Pat. No. 5,860,824, which issued to Fan on Jan. 19, 1999, describes an extension device for mounting in automobile cigarette lighter holder. An extension device adapted to be mounted in the automobile cigarette lighter holder includes an adaptor side and configured to be fit into the automobile cigarette lighter holder, an end holder for holding a mobile phone, a power outlet section arranged between the adaptor and the end holder and connected thereto by a means of a first and second connector both of which are capable to rotate about two diagonal axes to allow the adjustment of spatial location of the mobile phone. The adaptor has a central bore inside which a plug, serving as the negative contact, is received and spring bias to be contacted engageable with the negative contact of the cigarette holder. The adaptor also has a plurality of flutes formed on a side surface, inside each of which a resilient strip is received to serve as a positive contact. The strip has a U-shaped end. An adjusting ring is movably engaged on the adaptor having a wedging face in camming engagement with the U-shaped end of the resilient strip so that by moving the adjusting ring, the camming action between the wedging face and the resilient strip forces the strip to expand outward and is thus secured inside the cigarette holder. A speaker may be provided inside the power outlet section and in signal communication with the mobile phone.

U.S. Pat. No. 5,708,706, which issued to Hughes et al on Jan. 13, 1998, describes a connector lead for a transceiver unit. A mobile telephone apparatus comprises a transceiver unit having a handset cradle, signal antenna and port for the connection of a handset, external loudspeaker/microphone, power supply, etc. A power lead for connecting the power supply port of the apparatus to a cigarette lighter socket is stored when not in use by plugging the cigarette lighter adaptor at one end of the lead into a dummy socket formed in a housing which is detachably connected to the transceiver unit. The lead is combined with a carrying strap, one end of which is connected to the cigarette adaptor and the other end of which is detachably connectable to a retaining slot on the transceiver unit.

U.S. Pat. No. 5,633,538, which issued to Nickerson on May 27, 1997, describes an active and illuminated information module for a motor vehicle's cigar/cigarette lighter or other power receptacles. An attachment for a cigarette light receptacle in a vehicle simulates the external shape, size, and appearance of a conventional vehicle cigarette lighter which is normally seated in the cigarette lighter receptacle. A control circuit, light source, smoke detector, and alarm are housed in the attachment. The attachment includes electrical contacts which are connected to the control circuit and which also, when the attachment is seated in the cigarette lighter receptacle, interconnect the control circuit with both the ground and electrical contact of the vehicle cigarette lighter receptacle.

U.S. Pat. No. 5,007,863, which issued to Xuan on Apr. 16, 1991, describes a module-type multi-function electrical power adaptor for automobiles and the like. The invention is a power outlet adaptor for use in add-on electrical accessories in an automobile vehicle having a cigarette lighter socket. This device embodies a plurality of separate attachable modules which may be attached to a basic module insertable into the light socket and constructed to receive the additional modules, so as to provide multiple electrical outputs. Such a module-type arrangement allows the adapter to fit the mounting space of cigarette light sockets in various vehicles, boats, campers, and the like.

U.S. Pat. No. 4,842,235, which issued to Brown et al, on Jun. 27, 1989, describes an automobile clip board and light unit. An illuminated clip board for a motor vehicle is provided that includes a male cigarette lighter adaptor plug which is placed into a female cigarette lighter socket on a dashboard for supplying power to the lamp of the clipboard.

The male adaptor plug stabilizes the clipboard so that a person can see information and write on the clipboard.

U.S. Pat. No. 4,286,262, which issued to Wahl on Aug. 25, 1981, describes an electronic transmitter device. A system for opening garage doors in which a radio receiver in the garage, upon receipt of a signal operates to open the garage door and in which a casing containing a radio transmitter is adapted for insertion into the socket of a cigarette lighter in the driver's compartment of a motor car is described. Switch means are providing for connecting this transmitter with a source of electrical power to actuate the transmitter and emit a radio signal at a frequency to which the receiver is receptive when the casing is inserted into the socket.

U.S. Pat. No. 6,273,771, which issued to Buckley et al on Aug. 14, 2001, discloses a control system for a marine vessel. A control system for a marine vessel incorporates a marine propulsion system that can be attached to a marine vessel and connected in signal communication with a serial communication bus and a controller. A plurality of input devices and output devices are also connected in signal communication with the communication bus and a bus access manager, such as a CAN Kingdom network, is connected in signal communication with the controller to regulate the incorporation of additional devices to the plurality of devices in signal communication with the bus whereby the controller is connected in signal communication with each of the plurality of devices on the communication bus. The input and output devices can each transmit messages to the serial communication bus for receipt by other devices.

The patents described above are hereby expressly incorporated by reference in the description of the present invention.

It is well known to those skilled in the art that a female cigarette lighter receptacle in a vehicle, such as an automobile or a boat, can also be used to provide electrical power to devices other than the male socket inserted into the cigarette lighter receptacle. As an example which is known to those skilled in the art, various types of air pumps, directional compasses, and radar detectors are provided with a male plug that is insertable into a standard automobile female cigarette lighter receptacle in order to provide electrical power to the portable device.

In certain circumstances, portable electrical devices require not only an electrical power connection to a power source but, in addition, they may also require data lines to be connected to allow the portable electrical device to communicate information to a component associated with the vehicle. An example of this type of information is the use of a portable global positioning satellite (GPS) system in a vehicle, such as a marine vessel.

The portable GPS requires electrical power to be provided to it. However, it also often requires data lines to be connected between the portable GPS unit and the information processing system of the marine vessel if the GPS information is to be used in association with other peripheral devices on the marine vessel, such as a microprocessor, display screen, or sophisticated propulsion control module (PCM) associated with a data bus of the marine vessel. It would therefore be significantly beneficial if a connector could be provided that allows both electrical power and data connections to be made simultaneously in one simple operation between a portable electrical device, such as a portable GPS unit, and an electrical system of a vehicle such as a marine vessel. Typically, the power connection is made through the use of a cigarette lighter connector and the data connection is made separately between the portable electrical device and the information processing is system of the vehicle.

SUMMARY OF THE INVENTION

An electrical connection device for connecting an electrical device to a vehicle's electrical system, made in accordance with the preferred embodiment of the present invention, comprises a tubular receptacle. It also comprises a power contact, disposed within the receptacle, which is connectable in electrical communication with a first terminal of an electrical battery. A ground contact, disposed within the receptacle, is connectable to a second terminal of the electrical battery. An input data contact, disposed within the receptacle is connectable in electrical communication with an information processing device of the vehicle.

In a preferred embodiment of the present invention, the vehicle is a marine vessel.

An embodiment of the present invention further comprises an output data contact, disposed within the receptacle, which is connectable in electrical communication with the information processing system.

A preferred embodiment of the present invention can further comprise an auxiliary ground contact disposed within the receptacle for use in conjunction with a portable electrical device.

In a particularly preferred embodiment of the present invention, the tubular receptacle comprises a cylindrical cavity with the power contact and input data contact extending radially into the cylindrical cavity.

The power contact can be supported at a central position of an enclosed end of the tubular receptacle. The ground contact can be a conductive portion of the cylindrical cavity.

A particularly preferred embodiment of the present invention can further comprise an insert which is shaped to be received within the tubular receptacle. In a preferred embodiment, a power terminal is attached to the insert and movable into electrical communication with the power contact when the insert is disposed within the tubular receptacle. Similarly, a ground terminal is attached to the insert and is movable into contact with the ground contact when the insert is disposed within the tubular receptacle. Also, a data terminal is attached to the insert and is movable into contact with the data contact when the insert if disposed within the tubular receptacle.

In a particularly preferred embodiment of the present invention, it further comprises a threaded open end of the tubular receptacle and a threaded cap attached to the insert, wherein the cap is attachable to the threaded open end of the tubular receptacle to retain the insert within the tubular receptacle. It should be understood that the threaded attachment of the insert to the tubular receptacle is not a requirement in all embodiments of the present invention. The power terminal is connectable in electrical communication with a portable electrical device. The data terminal is connectable in electrical communication with a portable electrical device.

The present invention has particular application when a portable electrical device, such as a portable GPS unit, is used in conjunction with an information processing system of a motor vehicle. However, it should be understood that many portable electronic devices can take advantage of the multi-purpose tubular receptacle provided by the present invention. In addition, the tubular receptacle can be made in a manner that is very similar in shape and configuration to a standard female cigarette lighter receptacle. Even though the modified female cigarette lighter receptacle of the present invention is capable of connecting a portable component to the electrical system of a vehicle in both electrical communication and signal communication to allow electrical power to be provided to the portable device and, in addition, to allow data to be exchanged between the portable device and an information processing system of the vehicle, it can also serve to provide power to a standard male cigarette lighter insert.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
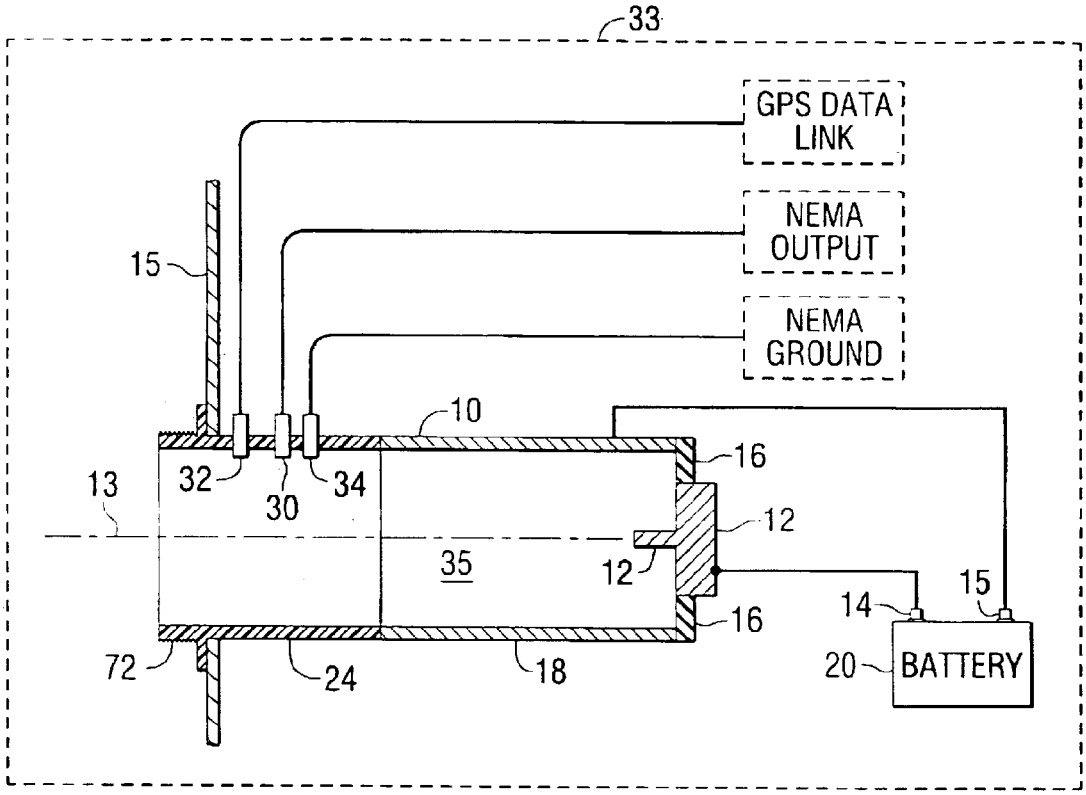
FIG. 1 is a highly schematic representation of a tubular receptacle of the present invention.

Throughout the description of the preferred embodiment of the present invention, like components will be identified by like reference numerals.

FIG. 1 is a highly simplified schematic representation of an electrical connection device employing the concepts of the present invention. It comprises a tubular receptacle 10 which, in a preferred embodiment, is cylindrical in shape as represented by centerline 13 and attachable to a dashboard 15 of the marine vessel 33. The power contact 12, which is connectable in electrical communication with a first terminal 14 of an electrical battery is supported by and disposed within the receptacle 10. Preferably, an insulative annular member 16 is used to support the power contact 12 at a closed end of the tubular receptacle 10 in a manner that insulates the power contact 12 from electrical contact with a ground contact 18 which is also supported by and disposed within the receptacle and which is connectable to a second terminal 15 of the electrical battery 20. In the embodiment shown in FIG. 1, the ground contact 18 is the structure of a portion of the tubular receptacle 10 which is made of a conductive material. The tubular receptacle 10 also comprises a non-conductive portion 24 that allows other contacts to be supported by the tubular receptacle but not connected in electrical or signal communication with the power contact 18.

With continued reference to FIG. 1, several other contacts are provided. For example, an input data contact 30, which is disposed within the receptacle 10, is connectable in electrical communication with an information processing device of the vehicle. As an example, the input data contact 30 can be wired directly to a propulsion control module (PCM), helm control module, or data bus of a marine vessel 33. When an insert, which will be described in greater detail below, is disposed in the cylindrical cavity 84 of the tubular receptacle 10, the input data contact 30 allows data to be transferred from a portable component, such as a hand-held GPS unit, to the information processing equipment of the marine vessel.

An output data contact 32 allows date to be transmitted in the opposite direction, from the information processing component of the marine vessel to the portable device, such as a hand-held GPS unit. In this way, an information display portion of the portable electrical device can be used to display additional information received from the information processing system of the marine vessel 33. As an example, if the portable electrical device is a GPS unit, it can be enabled to display data such as engine speed, vehicle speed, oil temperature, or remaining fuel capacity that is received through contact 32 from the information system of the marine vessel 33.

In certain embodiments of the present invention, an auxiliary ground contact 34 can be provided for connection to the ground of the portable device.

The tubular receptacle 10, as described above, can comprise a cylindrical cavity 35, but other shapes of the cavity 35 are possible within the scope of the present invention. The power contact 12 and the input data contact 30 extend radially into cylindrical cavity 35. The power contact 12 is supported at a central position, as shown in FIG. 1 of an enclosed end of the tubular receptacle 10. The ground contact 18 is a conductive portion of the cylindrical cavity 35.

With continued reference to FIG. 1, it should be understood that the addition of the data-related contacts, 30, 32, and 34, to the female connector does not prevent it from also operating as a standard cigarette lighter when not in use to connect a portable electrical device to the electrical system of a marine vessel 33. The addition of the insulative portion 24 of the tubular receptacle 10 and the three contacts, 30, 32, and 34, do not prevent this very well known use of this type of female receptacle.

Figure 2:
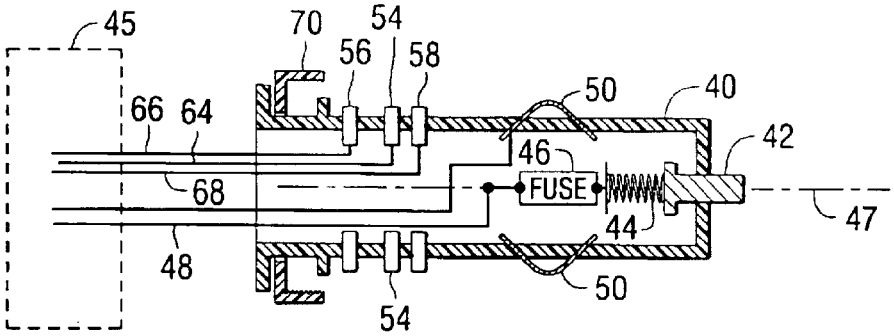
FIG. 2 is a highly simplified schematic representation of an insert of the present invention usable in conjunction with the tubular receptacle of FIG. 1.

In a particularly preferred embodiment of the present invention, the female receptacle shown in FIG. 1 is used in conjunction with a male insert illustrated in a simplified schematic diagram in FIG. 2.

Ant insert 40 is shaped to be received within the tubular receptacle 10. The insert 40 generally appears similar to a standard cigarette lighter insert that is well known to those skilled in the art, but additional components are added to it to enable the simultaneous connection of both electrical power and data lines between an electrical system of a marine vessel and a portable electrical device, such as a hand-held GPS unit 45. The insert 40, in a preferred embodiment, is cylindrical as represented by the centerline 47. A power terminal 42 is attached to the insert 40 and is movable into electrical communication with the power contact 12 described above in conjunction with FIG. 1 when the insert 40 is disposed within the is tubular receptacle 34. The power terminal 42 is axially movable relative to the insert 40 in a particularly preferred embodiment of the present invention. A spring 44 urges the power terminal 42 toward the right and into contact with the power contact 12 described above in conjunction with FIG. 1. In addition, a fuse 46 is disposed in serial electrical communication with a wire 38 that allows the power terminal 42 to be connected to the portable electrical device to provide electrical energy to that device.

With reference to FIGS. 1 and 2, a ground terminal 50 is attached to the insert 40 and is movable into contact with the ground contact 18 when the insert 40 is disposed within the tubular receptacle 10. The construction and configuration of the ground terminal 50 is similar to those used in well known inserts of cigarette lighters. A data terminal 54 is attached to the insert 40 and is movable into contact with the data contact 30 of the tubular receptacle 10 when the insert 40 is disposed within the cylindrical cavity 35. Similarly, the insert 40 is provided with an output data terminal 56 which is movable into electrical contact with the date output data contact 32 when the insert 40 is disposed within the cavity 35 of the tubular receptacle 10. Also, an auxiliary ground terminal 58 is attached to the insert 40 and movable into electrical contact with the auxiliary ground contact 34 of the tubular receptacle 10. As shown, lines 64, 66, and 68 are connected to terminals 54, 56, and 58, respectively. These lines allow these terminals to be connected to appropriate connection points within a portable electrical device, such as a hand-held GPS unit. Furthermore, line 48 allows electrical power to be connected to the portable electrical device and line 60 allows the ground terminal 50 to be connected to the portable electrical device.

As illustrated in FIG. 2, the present invention can be provided with a threaded cap 70 which can be used to more firmly attach the insert 40 to the tubular receptacle 10 by threading the cap 70 unto the threads 72 provided at the open end of the tubular receptacle 10. However, it should be clearly understood that the use of threaded caps and threaded open ends are not necessary in all embodiment of the present invention. Instead, the friction provided by the relative sizing of the insert 40 and the tubular receptacle 10 is generally sufficient to retain the insert in place after it has been pushed into the cavity 35. This type of attachment is well known to those skilled in the art and is used in virtually all currently manufactured automobile type cigarette lighters.

With continued reference to FIGS. 1 and 2, when the insert 40 is disposed into the cavity 35 of the tubular receptacle 10 the power terminal 42 moves into contact with the power contact 10 to provide power from the battery 20, on line 48, to the portable electrical device. The ground terminal 50 moves into contact with the ground contact 18 of the tubular receptacle 10 to connect the ground system of the portable electrical device to the ground system of the marine vessel and to the second terminal 15 of the battery 20. When the three terminals, 54, 56, and 58, of the insert 40 are moved into electrical contact with the three contacts, 30, 32, and 34, of the tubular receptacle 10, the portable device can communicate data through terminal 54 to contact 30 and, as a result, to the information processing system of the marine vessel. Similarly, the portable electrical device can receive data from contact 32 to terminal 56 so that the portable electrical device can either display or use data provided from the information processing system of the marine vessel. This same position of the insert 40 within the cavity 35 results in the electrical connection between the ground contact 34 and the ground terminal 58.

Figure 3:
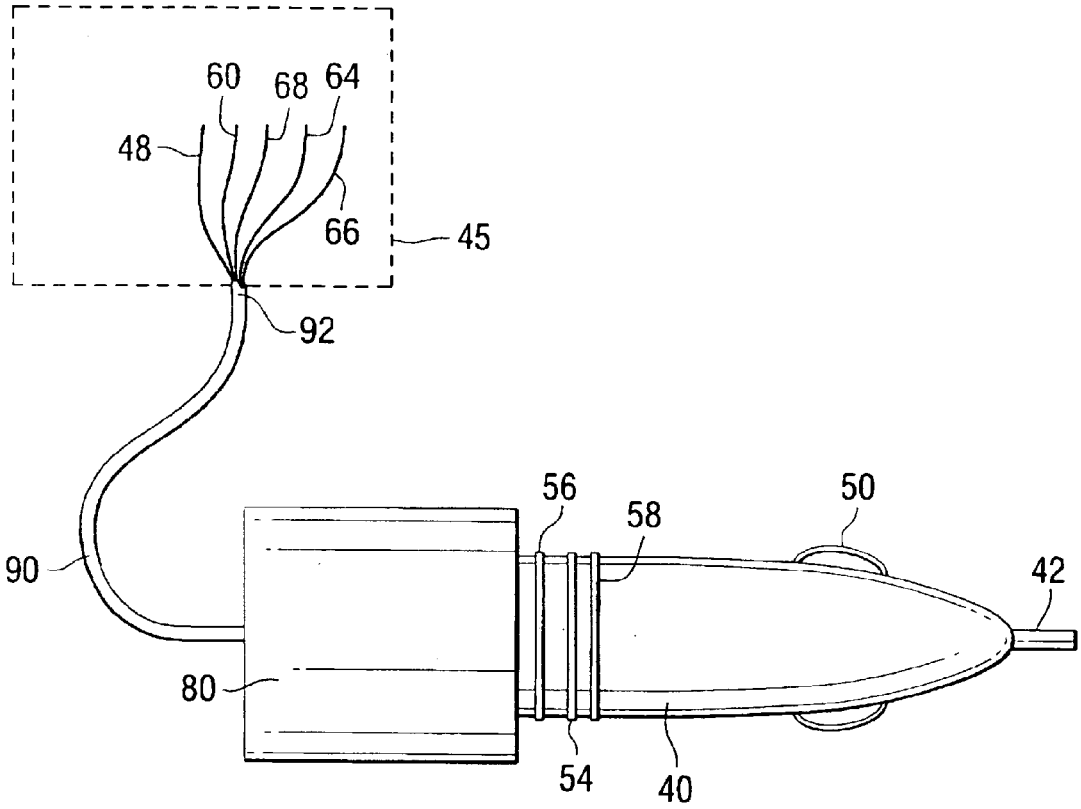
FIG. 3 is an alternative illustration of the present invention.

As can be seen, the insertion of the insert 40 into the cavity 35 provides connection to both electrical power from the battery 20 to a portable device, such as a GPS, and also simultaneously provides data connections in associations with contacts 30 and 32 and terminals 54 and 56. Furthermore, an auxiliary ground connection is made between contact 34 and terminal 58. All of these connections, both electrical energy connections and data connections are made simultaneously through the simple motion of inserting the insert 40 into cavity 35 of the tubular receptacle 10. Notwithstanding this multiple function provided by the present invention, the tubular receptacle 10 can also serve as a standard cigarette lighter with normal and commonly used male cigarette lighter inserts FIG. 3 is a highly simplified illustration of the insert 40. As can be seen, the ground terminals 58 are spring-like bands of metal that are generally similar to those used on standard cigarette lighters. The power terminal 42 extends outwardly from the nose of the insert 40 so that it can easily be moved into electrical contact with the power contact 12 of the tubular receptacle of the present invention. Three metal rings are attached to the internal wiring of the insert 40 and disposed on the outer surface of the insert 40 as shown in FIG. 3. These rings are disposed on the outer surface of the insert 40 and provide the function of terminals 54, 56, and 58 which are described above. It can be seen that the relative spacing of the three contacts, 30, 32, and 34, and the three terminals, 54, 56, 58, are selected to define unequal spacing between rings 54 and 56 and rings 54 and 58 in the particular embodiment shown in FIG. 3. This particular spacing convention isn't limiting to the present invention.

Figure 4:
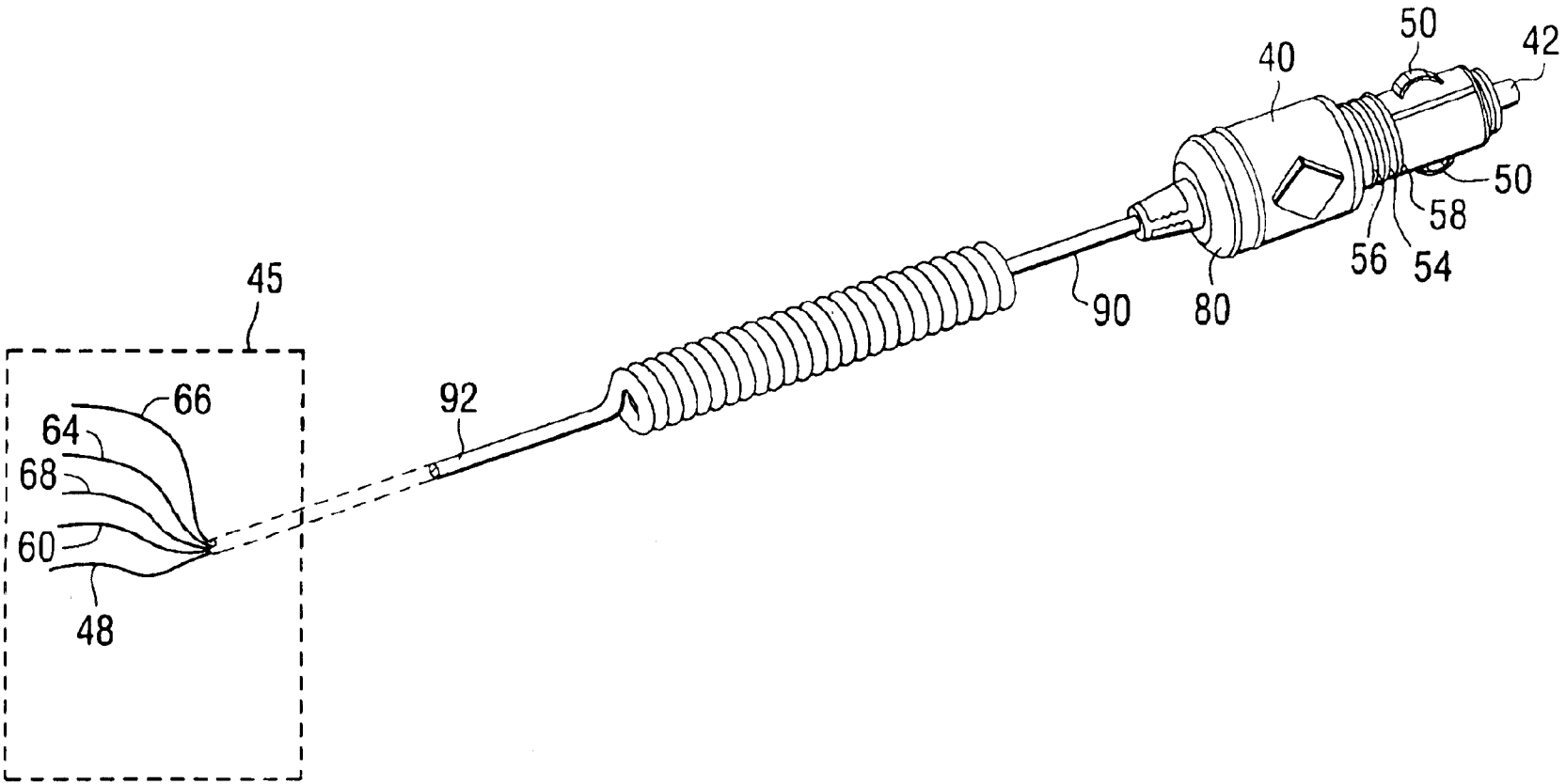
FIG. 4 is an isometric representation of the insert of the present invention and an associated cable containing five wires to provide connection of both power and data lines between the tubular receptacle and a portable electrical device.

FIG. 4 is an isometric illustration of the insert 40 that can be used in a preferred embodiment of the present invention. As can be seen, it is generally similar in appearance to a standard male cigarette insert, but with certain advantageous additional elements. When the insert 40 is disposed in the cavity 35 of the tubular receptacle 10 as described above in conjunction with FIGS. 1 and 2, the power terminal 42 moves into electrical communication with the power contact 12 of the tubular receptacle 10. The ground terminal 50 moves into contact with the ground contact 18 of the tubular receptacle 10. Simultaneously, the three metal rings, 54, 56, and 58, move into contact with the associated contacts, 30, 32, and 34, to provide signal communication both from an information processing system of the marine vessel to the portable electrical device and also from the portable electrical device to the information processing system of the marine vessel. In addition, a ground contact is provided through metal band 58. A cable 90 contains wires 48, 60, 64, 66, and 68, as described above in conjunction with FIG. 2. At the opposite end 92 of the cable 90, a portable electrical device is connected. As described above, the portable electrical device can be any one of numerous components. Typically, a portable GPS unit is particularly suitable for this type of connection. Within the cable 90, the five wires described above in conjunction with FIG. 2 are contained and connected to the portable electrical device. With reference to FIGS. 2 and 4, the cable 90 can contain a red wire 48 to provide 12 volt power to the portable electrical device from power terminal 42. A black wire 60 would provide a connection to the ground terminal 50. A yellow wire would provide a connection between terminal 56 and a data receiving portion of the portable electrical device. Terminal 54 can be connected to a white wire with blue stripes and terminal 58 would be connected to a blue wire with white stripes. It should be understood that different conventions can also be used.

The present invention allows a vehicle, such as a marine vessel, to be provided with a particularly adapted tubular receptacle 10 which appears to be generally similar to a standard female cigarette lighter receptacle, but with added components that allow data to be transmitted through the connector simultaneously with electrical power. In this way, a similarly designed insert 40 can be used to connect a portable electrical device, such as the GPS unit 45, to the power supply of the marine vessel and, simultaneously, to the information processing capability of the marine vessel. These capabilities can be associated with a propulsion control module of the marine vessel, a display monitor, or a data bus associated with the marine vessel. In a particularly connection to the tubular receptacle 10 is not limiting to the present invention. In addition, it should be understood that the tubular receptacle 10 can also serve as a power source for a standard and well known male cigarette lighter insert. The provision of the present invention eliminates the need for separate wires to be connected between a portable electrical device and a data system of the vehicle in addition to the provision of electrical power through the use of a standard female cigarette lighter receptacle. Not only is the connection process made much simpler made through the use of the present invention, but the arrangement of wires is also much more compact.

Although the present invention has been described in particular detail and illustrated to show a preferred embodiment, it should be understood that alternative embodiments are also within its scope.

I claim:

1. A connection system for connecting an electrical device to a vehicle electrical system, comprising:

a receptacle, said receptacle comprising a generally cylindrical cavity having a circular cross section;

a power contact, supported by said receptacle, which is connectable in electrical communication with a first terminal of an electrical power source;

a ground contact, supported by said receptacle, which is connectable in electrical communication with a second terminal of said electrical power source; and an input data contact, supported by said receptacle, which is connectable in electrical communication with an information processing device of said vehicle, said input data contact being disposed on a radially inward cylindrical surface of said generally cylindrical cavity of said receptacle.

2. The system of claim 1, wherein;

said receptacle is a female portion of a vehicle cigarette lighter.

3. The system of claim 1, wherein:

said electrical power source is an electrical storage battery contained within said vehicle.

4. The system of claim 1, wherein:

said vehicle is a marine vessel.

5. The system of claim 1, further comprising:

an output data contact, supported by said receptacle, which is connectable in electrical communication with said information processing system, said output data contact being disposed on a radially inward cylindrical surface of said generally cylindrical cavity of said receptacle.

6. The system of claim 5, further comprising:

an auxiliary ground contact supported by said receptacle, said auxiliary round contact being disposed on a radially inward cylindrical surface of said generally cylindrical cavity of said receptacle.

7. The system of claim 1, wherein:

said power contact and said input data contact extends into said cylindrical cavity.

8. The system of claim 1, wherein:

said power contact is supported at a central position of an enclosed end of said receptacle.

9. A system of claim 7, wherein:

is said ground contact is a conductive portion of said cylindrical cavity.

10. The system of claim 6, further comprising:

an insert which is shaped to be received within said receptacle, said insert being generally cylindrical and having a circular cross section;

a power terminal attached to said insert, said power terminal being movable into electrical communication with said power contact when said insert is disposed within said receptacle;

a ground terminal attached to said insert, said ground terminal being movable into electrical communication with said power contact when said insert is disposed within said receptacle;

an auxiliary ground terminal attached to said insert and movable into contact with said auxiliary ground contact when said insert is disposed within said receptacle; and a data terminal attached to said insert and movable into contact with said data contact when said insert in disposed within said receptacle, said data terminal being disposed on a radially outward cylindrical surface of said insert.

11. The system of claim 10, further comprising:

a threaded open end of said receptacle; and a threaded cap attached to said insert, said cap being attachable to said threaded open end to retain said insert within said receptacle.

12. The system of claim 10, wherein:

said power terminal is connectable in electrical communication with a portable electrical device.

13. The system of claim 10, further comprising:

said data terminal is connectable in electrical communication with a portable electrical device.

14. A connection system for connecting an electrical device to a vehicle electrical system, comprising:

a tubular receptacle, said tubular receptacle comprising a generally cylindrical cavity having a circular cross section;

a power contact, supported by said receptacle, which is connectable in electrical communication with a first terminal of an electrical power source;

a ground contact, supported by said receptacle, which is connectable in electrical communication with a second terminal of said electrical power source;

an input data contact, supported by said receptacle, which is connectable in electrical communication with an information processing device of said vehicle, said input data contact being disposed on a radially inward cylindrical surface of said generally cylindrical cavity of said tubular receptacle; and an output data contact, supported by said receptacle, which is connectable in electrical communication with said information processing system, said output data contact being disposed on a radially inward cylindrical surface of said generally cylindrical cavity of said tubular receptacle.

15. The system of claim 14, wherein:

said electrical power source is an electrical storage battery contained within said vehicle.

16. The system of claim 15, wherein:

said vehicle is a marine vessel.

17. The system of claim 16, further comprising:

an auxiliary ground contact supported by said receptacle.

18. The system of claim 17, wherein:

said power contact and said input data contact extends into said cylindrical cavity.

19. The system of claim 18, wherein:

said power contact is supported at a central position of an enclosed end of said receptacle.

20. A system of claim 19, wherein:

said ground contact is a conductive portion of said cylindrical cavity.

21. The system of claim 20, further comprising:

an insert which is shaped to be received within said receptacle, said insert being generally cylindrical and having a circular cross section;

a power terminal attached to said insert, said power terminal being movable into electrical communication with said power contact when said insert is disposed within said receptacle;

a ground terminal attached to said insert, said ground terminal being movable into electrical communication with said power contact when said insert is disposed within said receptacle;

an auxiliary ground terminal attached to said insert and movable into contact with said auxiliary ground contact when said insert is disposed within said receptacle; and a data terminal attached to said insert and movable into contact with said data contact when said insert in disposed within said receptacle, said data terminal being disposed on a radially outward cylindrical surface of said insert.

22. The system of claim 21, wherein:

said power terminal is connectable in electrical communication with a portable electrical device.

23. The system of claim 22, further comprising:

said data terminal is connectable in electrical communication with a portable electrical device.

24. A connection system for connecting an electrical device to a vehicle electrical system, comprising:

a generally cylindrical receptacle, said generally cylindrical receptacle having a circular cross section;

a power contact, supported by said receptacle, which is connectable in electrical communication with a first terminal of an electrical power source;

a ground contact, supported by said receptacle, which is connectable in electrical communication with a second terminal of said electrical power source;

an input data contact, supported by said receptacle, which is connectable in electrical communication with an information processing device of said vehicle, said input data contact being disposed on a radially inward cylindrical surface of said generally cylindrical cavity of said cylindrical receptacle; and an output data contact, supported by said receptacle, which is connectable in electrical communication with said information processing system said output data contact being disposed on a radially inward cylindrical surface of said generally cylindrical cavity of said cylindrical receptacle.

25. The system of claim 24, wherein:

said vehicle is a marine vessel.

26. The system of claim 24, further comprising:

an auxiliary ground contact supported by said receptacle.

27. The system of claim 26, wherein:

said power contact and said input data contact extends into said cylindrical cavity, said power contact being supported at a central position of an enclosed end of said receptacle.

28. A system of claim 27, wherein:

said ground contact is a conductive portion of said cylindrical cavity.

29. The system of claim 27, further comprising:

an insert which is shaped to be received within said receptacle, said insert being generally cylindrical and having a circular cross section;

a power terminal attached to said insert, said power terminal being movable into electrical communication with said power contact when said insert is disposed within said receptacle;

a ground terminal attached to said insert, said ground terminal being movable into electrical communication with said power contact when said insert is disposed within said receptacle;

an auxiliary ground terminal attached to said insert and movable into contact with said auxiliary ground contact when said insert is disposed within said receptacle; and a data terminal attached to said insert and movable into contact with said data contact when said insert in disposed within said receptacle, said data terminal being disposed on a radially outward cylindrical surface of said insert.

30. The system of claim 29, wherein:

said power terminal is connectable in electrical communication with a portable electrical device and said data terminal is connectable in electrical communication with a portable electrical device.

* * * * *